US008689998B2

(12) United States Patent
Gowans et al.

(10) Patent No.: US 8,689,998 B2
(45) Date of Patent: Apr. 8, 2014

(54) LIQUID CONTAINER WITH MULTIPLE OPENINGS

(76) Inventors: Shane Gowans, Layton, UT (US); Matthew S. Dufala, Layton, UT (US)

( * ) Notice: Subject to any disclaimer, the term of this patent is extended or adjusted under 35 U.S.C. 154(b) by 896 days.

(21) Appl. No.: 11/807,033

(22) Filed: May 25, 2007

(65) Prior Publication Data

US 2007/0284332 A1 Dec. 13, 2007

Related U.S. Application Data

(60) Provisional application No. 60/808,414, filed on May 25, 2006.

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***B65D 51/18*** | (2006.01) |
| ***B65D 51/20*** | (2006.01) |
| ***B65D 6/40*** | (2006.01) |
| ***B65D 47/10*** | (2006.01) |
| ***B67B 1/00*** | (2006.01) |

(52) U.S. Cl.
USPC ..... 220/504; 220/526.1; 220/257.2; 220/601; 222/153.07; 222/541.1

(58) Field of Classification Search
USPC ..... 220/504, 257.2, 254.1, 309.1, 703, 916; 222/153.07, 541.4
See application file for complete search history.

(56) References Cited

U.S. PATENT DOCUMENTS

| | | | | |
|---|---|---|---|---|
| 1,650,764 | A | | 11/1927 | Marin |
| 2,086,404 | A | | 7/1937 | Daniels |
| 3,314,564 | A | * | 4/1967 | Eli et al. ..... 215/252 |
| 4,163,517 | A | | 8/1979 | Kappler |
| 4,205,760 | A | * | 6/1980 | Hasegawa ..... 220/271 |
| 4,265,381 | A | | 5/1981 | Muscatell |
| 4,762,241 | A | | 8/1988 | Lang |
| 4,768,688 | A | | 9/1988 | Harrigan |
| 4,901,880 | A | * | 2/1990 | Tatham et al. ..... 220/269 |
| 5,011,037 | A | | 4/1991 | Moen et al. |
| 5,071,042 | A | * | 12/1991 | Esposito ..... 222/570 |
| 5,141,136 | A | | 8/1992 | Tignor |

(Continued)

OTHER PUBLICATIONS

Cans of the Year Awards 1999—http://www.spgevents.com/coy/1999.htm.

(Continued)

*Primary Examiner* — Anthony Stashick
*Assistant Examiner* — Andrew T Kirsch
(74) *Attorney, Agent, or Firm* — Morriss O'Bryant Compagni

(57) ABSTRACT

Liquid containers featuring multiple apertures for accessing the contents in one of a number of selected fashions. In one illustrative embodiment, the container is shaped as a bottle, having a body and neck, with a first aperture at the top of the neck. A flat bottom or base opposite the neck features at least one aperture, such as a traditional soda can opening with a scored section and a tab. In some embodiments, the bottom includes multiple apertures of different sizes, allowing for the selection of an aperture of desired size for a particular application. In some embodiments, the entire bottom may function as a removable lid.

18 Claims, 6 Drawing Sheets

(56) References Cited

U.S. PATENT DOCUMENTS

| | | | | | |
|---|---|---|---|---|---|
| 5,154,295 | A | * | 10/1992 | Stoner | 206/509 |
| 5,181,632 | A | | 1/1993 | Latter | |
| 5,494,184 | A | * | 2/1996 | Noguchi et al. | 220/269 |
| 5,555,992 | A | * | 9/1996 | Sedgeley | 220/269 |
| 5,622,293 | A | | 4/1997 | LeFevre | |
| 5,829,607 | A | | 11/1998 | Ibrahim | |
| 6,015,060 | A | | 1/2000 | Rightenour et al. | |
| 6,131,763 | A | * | 10/2000 | Stanish et al. | 220/706 |
| 6,398,050 | B1 | | 6/2002 | Allora | |
| 6,581,811 | B1 | | 6/2003 | Schillaci | |
| 6,715,629 | B2 | | 4/2004 | Hartman et al. | |
| 6,905,038 | B2 | | 6/2005 | Lopez | |

OTHER PUBLICATIONS

Cans of the Year Awards 2000—http://www.spgevents.com/coy/2000.htm.
Cans of the Year Awards 2001—http://www.spgevents.com/coy/2001.htm.
Cans of the Year Awards 2003—http://www.spgevents.com/coy/2003.htm.
Cans of the Year Awards 2004—http://www.spgevents.com/coy/2004.htm.
Cans of the Year Awards 2005—http://www.spgevents.com/coy/2005.htm.
Cans of the Year Awards 2006—http://www.spgevents.com/coy/2006.htm.

* cited by examiner

LIQUID CONTAINER WITH MULTIPLE OPENINGS

CROSS-REFERENCE TO RELATED APPLICATION

This application claims the benefit of U.S. Provisional Application No. 60/808,414, filed May 25, 2006, which is incorporated herein by reference in its entirety.

TECHNICAL FIELD

The present invention relates generally to liquid and beverage containers and, more particularly, to containers for liquids that have multiple apertures.

BACKGROUND

Single opening liquid containers typically utilize a single large hole for venting the liquid to be dispensed. This single large hole is often a bottle opening at the top of a narrowed neck, or a single can opening. A problem with dispensing from a single apertured beverage container is that the flow of liquid may be limited by flow friction caused by an inadequate air supply, especially when the container is in the pouring position. The usual small elliptical openings may cause a surging or restricted flow, as outside air, which needs to enter the container during the outward flow of a liquid, such as a beverage, competes for the small space provided by the single opening. This forces an extensive release of carbonation, often resulting in a foam head on the beverage. Where the liquid is not a beverage, but is viscous, this can force the container to "gulp" or repeatedly contract then bulge outward as air is taken in, as with dispensing oil from a typical one-quart plastic container.

In order to facilitate a more controlled, efficient, even flow rate, a second aperture is desirable in the container, especially for beverages that are carbonated or malt beverages, such as beer. A container with both a pouring aperture and a venting aperture in the exterior surface of the can may be a valuable combination, allowing for foam reduction due to the increased venting and air flow that allows users to drink their carbonated or malt beverages quickly without the resulting feeling of bloating and upset stomach caused by consuming a large foam head as from traditional beverage containers.

Numerous devices are disclosed which attempt to address this venting problem. Generally, these devices are directed to cans for containing beverages. Some provide for two openings on the top of a can, one for pouring and one for venting. Such devices include those disclosed in U.S. Pat. No. 5,494,184, issued in the name of Noguchi et al., U.S. Pat. No. 5,397,014, issued in the name of Aydt, U.S. Pat. No. 5,285,919, issued in the name of Recchia, U.S. Pat. No. 5,011,037, issued in the name of Moen et al., U.S. Pat. No. 4,872,597, issued in the name of Hanafusa, U.S. Pat. No. 4,576,306, issued in the name of Kelsey et al., U.S. Pat. No. 3,970,212, issued in the name of Brown, U.S. Pat. No. 3,662,914, issued in the name of Slade, and U.S. Pat. No. 3,627,168, issued in the name of Fraze. The disclosure of each of these patents is incorporated by reference directly herein.

U.S. Pat. No. 6,015,060 to Rightenour, the disclosure of which is incorporated herein, attempts to address this situation by providing a beverage can which has a second opening in a sidewall, or on the bottom of the can. However, this container still fails to resolve certain issues. For example, opening both apertures may cause liquid to rapidly dispense from the can, resulting in spillage. Additionally, the single size of the opening does not allow for selection of the appropriate size for the specific application. Further, since no opening is located in a center of a surface, or on an elongated neck, it is difficult to create a seal around the opening.

Consequently, a liquid dispensing container that provided multiple dispensing methods from a single container for different customers would be an improvement in the art.

SUMMARY

The present invention includes liquid containers which feature multiple apertures for accessing the contents in one of a number of selected fashions. In one illustrative embodiment, the container is shaped as a bottle, having a body and neck, with a first aperture at the top of the neck. A flat bottom or base opposite the neck features at least one aperture, such as a traditional "soda can" opening with a scored section and a tab. In some embodiments, the bottom includes multiple apertures of different sizes, allowing for the selection of an aperture of desired size for a particular application. In some embodiments, the entire bottom may function as a removable lid.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, to the appendix attached hereto, and to the several drawings.

DETAILED DESCRIPTION

The present invention relates to containers for dispensing liquids, which feature more than one aperture for accessing the contents thereof. It will be appreciated by those skilled in the art that the embodiments herein described, while illustrative, are not intended to so limit the invention or the scope of the appended claims. Those skilled in the art will also understand that various combinations or modifications of the embodiments presented herein can be made without departing from the scope of the invention. All such alternate embodiments are within the scope of the present invention. Similarly, while the drawings depict illustrative embodiments of the devices and components in accordance with the present invention and illustrate the principles upon which the device is based, they are only illustrative and any modification of the invented features presented here is to be considered within the scope of this invention.

Figure 1:
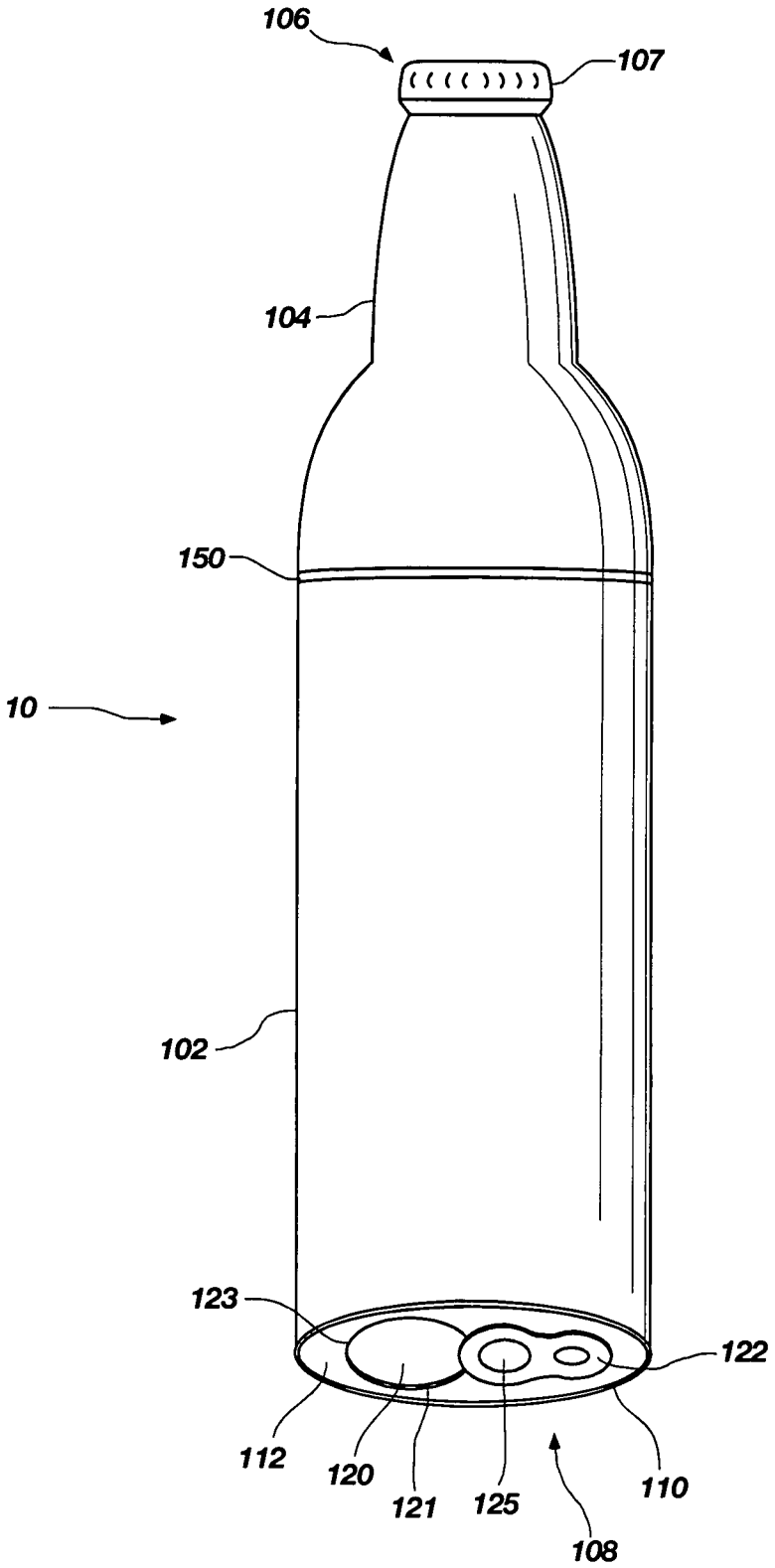
FIG. 1 is an elevated side view of a first embodiment of a container in accordance with the principles of the present invention.

FIG. 1 depicts one illustrative embodiment of a container in accordance with the principles of the present invention. A container 10 is depicted as having a generally columnar body 102 with a round cross-section and a narrowed neck 104 leading to a top aperture 106. In the depicted embodiment, the narrowed neck is topped off by a crown cork 107 or "bottle cap." This requires the distal end of narrow neck 104 to include suitable structures for the releasable attachment of the crown cork 107 thereto, as known to those of skill in the art. Examples of such suitable structures may include lips or suitable threads to which the crown cap may be crimped. It will be appreciated that, as discussed in other embodiments, top aperture 106 may be closed by other methods, such as threaded caps, including lug style caps, and twist close caps. Although depicted as having a round cross-section, it will be appreciated that, in other embodiments, the container 10 may have any desired cross-sectional shape, including polygons and irregular cross-sections.

As depicted, container 10 features a bottom 108, which generally forms a base. Bottom 108 may include an outer ridge or rim 110 which forms a base for supporting the container 10 when placed on a flat surface, such as a shelf or table. Inside rim 110, the bottom 108 of the can may be formed as a recessed flat surface 112. At least one lower aperture 120 is disposed on the surface 112. As depicted, the lower aperture 120 may be formed as a traditional "soda can" opening, featuring a scored section 121, which may be forced inwards, fracturing the surface 112 along the scored line 123. A tab 122 is attached to a central post 125 and may be used as a lever to force the lower aperture 120 open.

As depicted, the embodiment of FIG. 1 includes a single lower aperture 120. Where the container 10 is used as a beverage container, this allows a user to either remove the bottle cap 107 and drink from the container as if it were a bottle, or to invert the container, and drink from it as a standard beverage can. For rapid dispensing, as at a party, one aperture, such as the upper aperture 106 may be opened (by removal of bottle cap 107), and the container inverted over a receptacle. The second opening, such as lower aperture 120, may then be opened, allowing liquid contents to be rapidly dispensed as air enters the container 10 from above the liquid contents.

For use as a beverage dispensing container, container 10 may be formed from any suitable material, such as aluminum, steel, tin, or other metal, or from a plastic material. Container 10 may be constructed using traditional can construction techniques. For example, the container 10 may be formed by attaching a bottom piece to close an open end of a hollow cylinder to form a bottom 108, including the structures discussed herein. Such a hollow cylinder may include neck 104, or the body 102 including neck 104 could be formed by attaching a top piece which includes neck 104 to the other open end of the hollow cylinder, as indicated by the seam 150 in FIG. 1, showing the attachment of such a top piece.

Where the container 10, is used for non-potable liquids, the neck portion 104 may be utilized as a funnel. For example, if the container 10 holds a viscous liquid, such as motor oil, the cap may be removed and the neck used to insert into a narrow opening, such as an engine block oil reservoir. Opening lower aperture 120 allows the viscous liquid to flow out without "gulping" or spattering of the liquid.

Figure 2A:
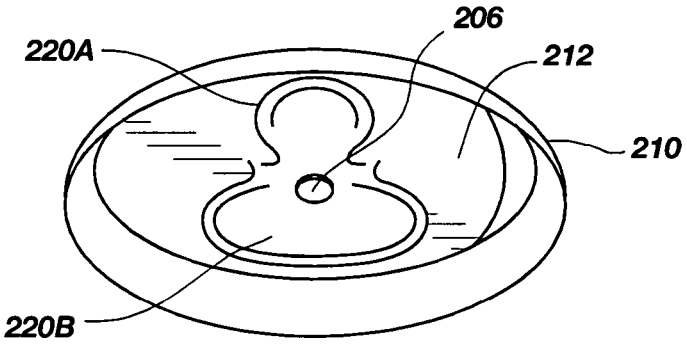
FIGS. 2A through 2C are bottom perspective views for one alternative embodiment of a bottom for a container in accordance with the principles of the present invention.
Figure 2B:
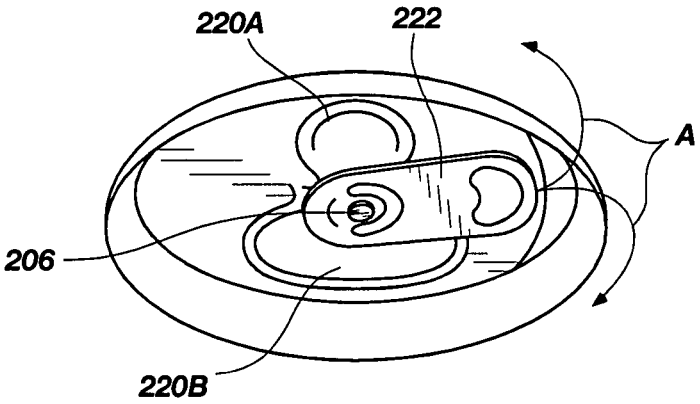
Figure 2C:
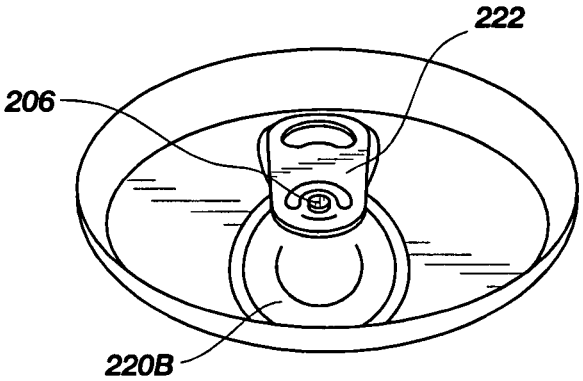

Turning to FIGS. 2A through 2C, a second embodiment of a bottom for a container 10 in accordance with the principles of the present invention is depicted. It will be appreciated that, although described in relation to container 10, the depicted bottom may also be used as a multiple apertured end for a liquid container, such as a soda can. As best depicted in FIG. 2A, a bottom surface 212 may have multiple openings. Two separate scored sections 220A and 220B may extend opposite one another from a central point, which may include a post 206 for connection to a levering tab 222 (shown in FIGS. 2B and 2C). Each scored section 220A or 220B may be forced inwards, fracturing the surface 212 along the scored line, if the tab 222 is used as a lever to force it open. The tab 222 may be rotated around post 206, as shown by arrows A, in order to select a scored section for opening.

As depicted, one scored section 220A is relatively smaller in comparison to the other scored section 220B. This allows for selection between the two scored sections to determine the flow from the container. For example, the smaller scored section 220A may be selected by itself for a slower flow, as when dispensing a beverage for a child, and the larger scored section 220B may be selected alone, for a faster flow for an adult. For dispensing from the bottom surface 212, both scored sections 220A and 220B may be selected, allowing for pouring through one of the openings to occur more smoothly due to increased air flow into the container. Where dispensing from the top aperture 106 (FIG. 1) is desired, selection between the scored sections may be used to effect a desired flow rate by different amounts of air.

Figure 3:
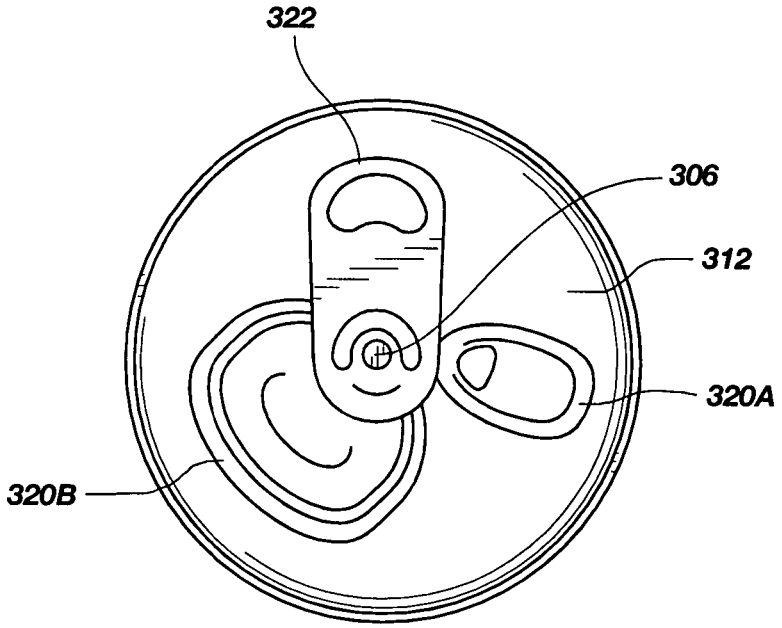
FIG. 3 is a plan view of another alternative embodiment of a bottom for a container in accordance with the principles of the present invention.

FIG. 3 depicts another arrangement for a bottom surface 312 having multiple openings. Two separate scored sections 320A and 320B may extend out from a central point, which may include a post 306 for connection to a levering tab 322. The scored sections 320A and 320B may be oriented at right angles to one another, requiring less rotation of the tab 322 for selection. It will be appreciated that any angular relationship between scored sections 320A and 320B may be used and that as many separate scored sections 320 as desired by the consumer and practicable for fitting on the surface 312 may be used.

Figure 4A:
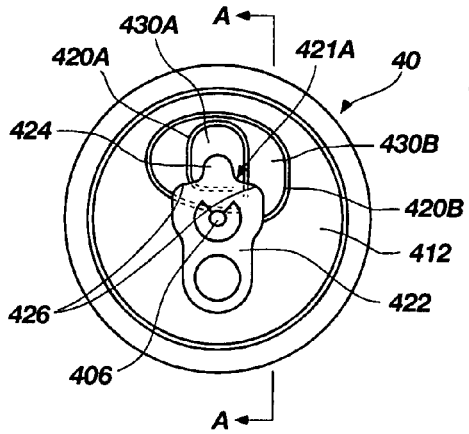
FIG. 4A is a top plan view of another alternative embodiment of a bottom for a container in accordance with the principles of the present invention.
Figure 4B:
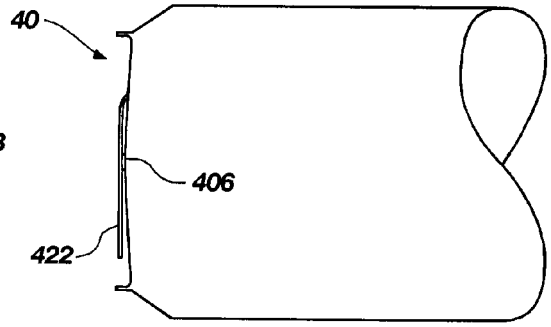
FIG. 4B is a cutaway side view of the embodiment of FIG. 4A.

FIGS. 4A through 4F depict another arrangement of a bottom surface 412 of a container 40. As depicted in FIG. 4A, a bottom surface 412 may have multiple openings. A first opening area 430A is defined by a scored boundary 420A and is disposed within a larger second opening area 430B defined by a second scored boundary 420B. A gap 421A or 421B between the ends of the respective scored boundary lines 420A or 420B connects the opening area 430A or 430B with the remainder of the bottom surface 412.

A post 406 is near the proximal edge of the larger second opening area 430B. In embodiments featuring a round container 10, post 406 may be disposed near the central point of the bottom surface 412. A levering tab 422 may be disposed on post 422, which acts as a fulcrum during levering. The distal edge of levering tab 422 has a distal tab 424 extending out past two shoulders 426, such that upon levering the rear portion 425 of the levering tab 422 upwards, the distal tab 424 will contact the bottom surface 412 before shoulder 426.

Upon actuation, a user raises the rear portion 425 of levering tab 422 upwards, forcing the distal edge downwards.

Figure 4C:
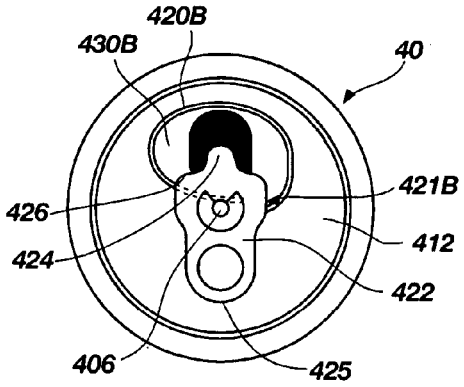
FIG. 4C is a top plan view of the embodiment of FIG. 4A showing actuation of one of the two apertures depicted therein.
Figure 4D:
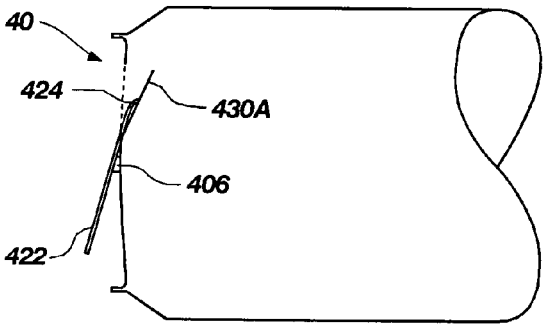
FIG. 4D is a cutaway side view of the embodiment of FIG. 4B.

Distal tab 424 contacts first opening area 430A, forcing it inwards and fracturing the surface 412 along the scored line 420A opening the first opening. This is best depicted in FIG. 4D. If desired, the levering tab 422 may then be returned to the unactuated position and the first opening used to dispense the contents of container 40, as depicted in FIG. 4C.

Figure 4E:
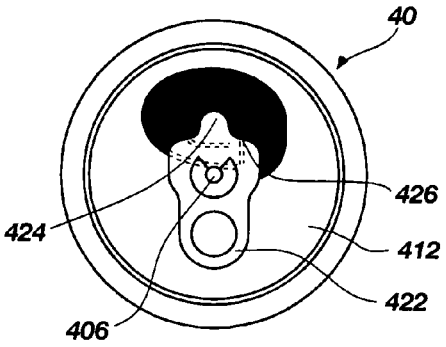
FIG. 4E is a top plan view of the embodiment of FIG. 4A showing actuation of a second aperture depicted therein.
Figure 4F:
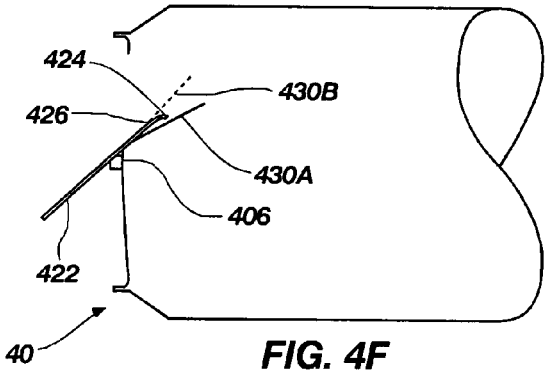
FIG. 4F is a cutaway side view of the embodiment of FIG. 4E.

If a larger opening is desired, the levering tab 422 may be levered further forward, to engage the shoulder 426 of the distal edge with the second opening area 430B, forcing it inwards and fracturing the surface 412 along scored line 420B, as depicted in FIG. 4F. The levering tab 422 may then be returned to the unactuated position and the second opening used to dispense the contents of container 40, as depicted in FIG. 4E.

Since the first opening area 430A is relatively smaller in comparison to second opening area 430B, this allows for selection between the two scored sections to determine the rate of flow from the container 40. For example, the smaller opening area 430A may be selected by itself for a slower flow, as when dispensing a beverage for a child, and the larger opening area 430B may be selected alone, as for a faster flow for an adult. Where dispensing from the top aperture 106 (FIG. 1) is desired, selection between the scored sections may be used to effect a desired flow rate by different amounts of air.

Figure 5:
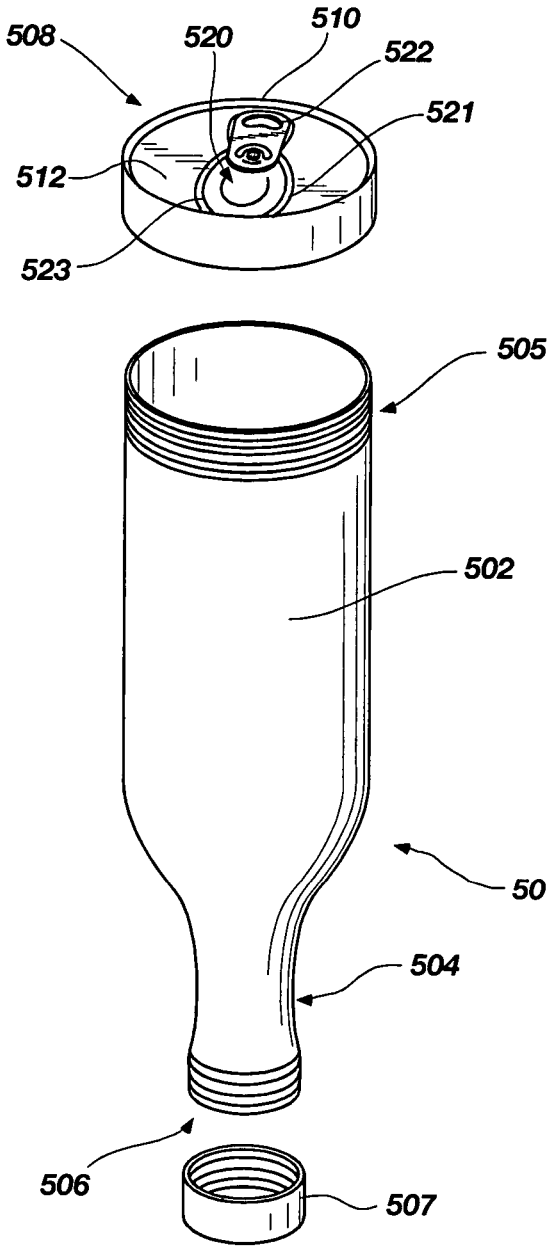
FIG. 5 is an exploded side view of another alternative embodiment of a container in accordance with the principles of the present invention.

Turning to FIG. 5, an exploded view of another embodiment in accordance with the principles of the present invention is depicted. Container 50 is depicted as having a generally columnar body 502 with a round cross-section and a narrowed neck 504 leading to a top aperture 506. The distal end of neck 504 is threaded to accept counterpart threading on a replaceable bottle cap 507. Although depicted as having a round cross-section, it will be appreciated that the container 50 may have any desired cross-sectional shape, including polygons and irregular cross-sections.

Container 50 includes an open bottom 505, which is threaded to accept counterpart threading on a removable bottom cap 508, which may be replaceable, and may generally form a base when attached. Bottom cap 508 may include an outer ridge or rim 510 which forms a base for supporting the container 50, when placed on a flat surface, such as a shelf or table. Inside rim 510, the bottom cap 508 may be formed as a recessed flat surface 512 featuring at least one lower aperture 520 disposed thereon. As depicted, lower aperture 520 may be formed as a traditional "soda can" opening, featuring a scored section 521, which may be forced inwards, fracturing the surface 512 along the scored line 523, as tab 522 is used as a lever to force the lower aperture 520 open. It will be appreciated that bottom cap 508 may feature additional lower apertures, as discussed previously herein.

Use of a removable bottom cap 508 provides an additional method for dispensing liquids from the container 50. Where the container 50 is used for beverages, in addition to the other dispensing methods discussed previously herein, removing the bottom cap 508 by rotation may allow a user to drink the contents as from a cup, or to pour out the contents from the larger opening. In other uses, the neck 504 of container 50 may be used to dispense in a narrowed area, (which may involve opening lower aperture 520 to vent the dispensing, as discussed previously herein). Once the initial contents are dispensed through the opening 506, the container 50 may remain in place and the bottom cap 508 may be removed, allowing container 50 to function as a funnel for directing the dispensing of additional flowable material therethrough.

Figure 6:
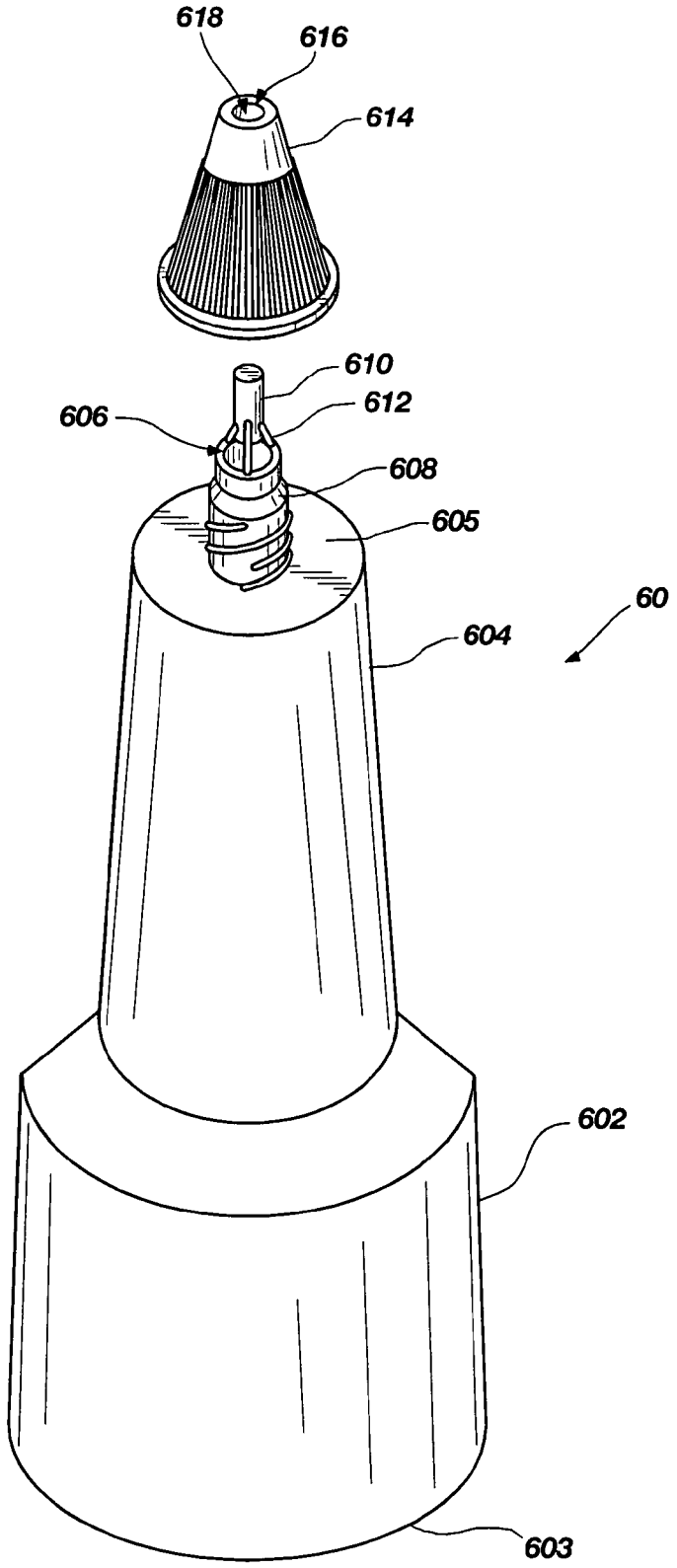
FIG. 6 is an exploded perspective view of another alternative embodiment of a container in accordance with the present invention.

FIG. 6 depicts a container 60 having a generally columnar body 602 with a round cross-section and a narrowed neck 604 leading to a distal end 605. A proximal end 603 contains one or more accessible apertures, as discussed previously herein. Although depicted as having a round cross-section, it will be appreciated that the container 60 may have any desired cross-sectional shape, including polygons and irregular cross-sections.

A top aperture generally indicated at 606 is disposed on the distal end 605 atop a threaded column 608. A plug 610 is disposed over top aperture 606, connected to column 608 by several legs 612. A twist cap 614 includes an opening 616 leading to a central channel 618. Channel 618 is threaded (not shown) to accept the counterpart threading column 602, such that plug 610 resides in opening 616, sealing access to top aperture 608. It will be appreciated that the embodiment depicted in FIG. 6 illustrates a resealable twist closure and that other resealable twist closures known to those of ordinary skill in the art may be utilized within the scope of the present invention.

The use of a resealable twist closure on the distal end of neck 604 allows for further flexibility in using containers in accordance with the present invention. For example, if a viscous fluid like motor oil is sold in such containers, this allows users the option of emptying the container rapidly without "gulping", as in dispensing a first quart of oil into a motor requiring several quarts (as previously discussed herein), while retaining the option of having a resealable opening when needed (as for the final bottle of oil, if the motor requires less than an entire quart of oil to be filled). This type of closure with a conical cap may assist to funnel the dispensed contents. In some embodiments, this may even allow the container 60 to dispense the contents dropwise, as from an oil can with a squeeze dispenser for dropwise dispensing, while retaining other dispensing options for a user.

While this invention has been described in certain embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A container for dispensing a liquid in multiple fashions, the container comprising:

a container body having a narrowed neck at a first end and a base at an opposite second end;

an upper aperture disposed at the distal end of the narrowed neck;

at least a first lower aperture disposed in the base comprising at least a first scored section, which may be forced inwards towards the first end, fracturing a surface of the base along a first scored line;

a post disposed on the base; and a levering tab disposed on the post, positioned such that actuating a rear portion of the levering tab away from the base forces a distal portion of the tab towards the first end.

2. The container of claim 1, further comprising a second lower aperture disposed in the base comprising a second scored section, which may be forced inwards, fracturing a surface of the base along a second scored line.

3. The container of claim 2, wherein the post is disposed at a mid-point of the base, and with the at least a first scored section and the second scored section disposed at an angle with respect to one another around the mid-point of the base, and the at least a first lower aperture and the second lower aperture can be selected by rotating the levering tab around the post.

4. The container of claim 3, wherein the at least a first scored section and the second scored section are disposed opposite one another around the mid-point of the base.

5. The container of claim 2, wherein the at least a first scored section is larger than the second scored section.

6. The container of claim 5, wherein the second scored section is disposed within the at least a first scored section.

7. The container of claim 6, wherein the distal portion of the levering tab includes a distal edge extending past at least one shoulder, such that actuating the rear portion of the levering tab away from the base forces the distal edge towards the first end to fracture the second scored section, opening the second lower aperture, and continued actuation forces the at least one shoulder towards the first end to fracture the at least a first scored section, opening the at least a first lower aperture.

8. The container of claim 1, wherein the upper aperture is closed by a crown cap crimped to the narrowed neck.

9. The container of claim 8, wherein the narrowed neck is threaded for attachment to the crown cap.

10. The container of claim 1, wherein the narrowed neck is threaded for replaceable removal of a cap.

11. The container of claim 1, wherein the cap comprises a lug style cap.

12. The container of claim 1, wherein a resealable twist closure is disposed at the distal end of the narrowed neck for closure of the upper aperture.

13. The container of claim 1, wherein a bottom portion of the container is threaded for replaceable removal of the base.

14. The container of claim 1, wherein the container is constructed of aluminum.

15. An end for a beverage container, comprising a surface forming an end of a beverage container having a first side outside the container;

a first dispensing aperture disposed in the surface comprising a first scored section defined by a first scored boundary line partially encircling the first dispensing aperture from a first end to a second end and defining a first gap on the surface between the second end and the first end, which may be forced inwards, fracturing the surface along the first scored boundary line as the surface at the first gap is bent inward;

a second dispensing aperture disposed in the surface comprising a second scored section defined by a second scored boundary line partially encircling the second dispensing aperture from a first end thereof to a second end thereof and defining a second gap on the surface between the second and first ends of the scored boundary line, which may be forced inwards, fracturing the surface along the second scored boundary line as the surface at the second gap is bent inward, the second scored section disposed within the first scored section such that the second gap is within the area defined by the first scored boundary line and is distal to the first gap;

a post disposed on the surface; and a levering tab disposed on the post, positioned such that actuating a rear portion of the levering tab away from the container forces a distal portion of the tab towards the container, the levering tab including a distal edge extending past at least one shoulder, such that actuating the rear portion of the levering tab away from the surface forces the distal edge towards the container to fracture the second scored boundary line and bend the surface at the second gap inward, opening the second dispensing aperture, and continued actuation of the levering tab forces the at least one shoulder towards the container to fracture the first scored boundary line and bend the surface at the first gap inward, opening the first dispensing aperture.

16. The end for a beverage container of claim 15, wherein the distal edge extending past at the at least one shoulder of the levering tab is positioned, such that actuating the levering tab to move the rear portion thereof back towards the surface after opening the second dispensing aperture removes the distal edge of the levering tab from the second dispensing aperture such that a distal end of the second dispensing opening is accessible distal to the levering tab.

17. A container for dispensing a liquid in multiple fashions, the container comprising:

a container body having a narrowed neck at a first end and a base at an opposite second end;

an upper aperture disposed at the distal end of the narrowed neck;

at least a first lower aperture disposed in the base comprising at least a first section, which may be forced inwards towards the first end, creating an opening through the base along a first line;

a second lower aperture disposed in the base comprising a second section, which may be forced inwards towards the first end, creating an opening through the base along a second line;

a post disposed on the base; and an opening tab disposed on the post, positioned such that actuating the opening tab forces a portion of the tab towards the first end.

18. The end for a beverage container of claim 16, wherein actuating the levering tab after opening the first dispensing aperture to move the rear portion thereof back towards the surface removes the distal edge of the levering tab from the first dispensing aperture such that a distal end of the first dispensing opening is accessible distal to the levering tab.

* * * * *